US009951950B2

(12) United States Patent
Hohman

(10) Patent No.: US 9,951,950 B2
(45) Date of Patent: Apr. 24, 2018

(54) GAS EXCHANGE TERMINATION SYSTEM

(71) Applicant: John E. Hohman, Evart, MI (US)

(72) Inventor: John E. Hohman, Evart, MI (US)

( * ) Notice: Subject to any disclaimer, the term of this patent is extended or adjusted under 35 U.S.C. 154(b) by 142 days.

(21) Appl. No.: 15/173,980

(22) Filed: Jun. 6, 2016

(65) Prior Publication Data

US 2017/0350594 A1 Dec. 7, 2017

(51) Int. Cl.
*F23L 17/04* (2006.01)
*F23J 11/00* (2006.01)

(52) U.S. Cl.
CPC ..... *F23L 17/04* (2013.01); *F23J 11/00* (2013.01); *F23J 2211/101* (2013.01)

(58) Field of Classification Search
CPC ..... F23L 17/04; F23J 11/00
USPC ..... 454/8
See application file for complete search history.

(56) References Cited

U.S. PATENT DOCUMENTS 4,940,042 A * 7/1990 Moore, Jr. ..... F23L 17/04 122/18.2
5,562,088 A 10/1996 Valters
6,044,835 A * 4/2000 Brown ..... F23L 17/04 126/307 A
6,053,162 A * 4/2000 Godfree ..... F23L 17/04 126/293
6,289,886 B1 * 9/2001 Radke ..... F23L 17/04 126/307 A
6,484,712 B1 * 11/2002 Lyons ..... F23L 17/04 126/85 B
7,458,888 B2 * 12/2008 Huta ..... F23L 17/02 454/36
8,408,196 B2 * 4/2013 Jacklich ..... F23J 13/025 126/15 R
8,672,614 B1 * 3/2014 Fitzpatrick ..... F04D 17/164 415/116
2002/0197948 A1 * 12/2002 Goncalves ..... F23L 17/04 454/8
2010/0065046 A1 * 3/2010 Juanico ..... F23L 17/04 126/85 B

* cited by examiner

*Primary Examiner* — Albert Wong

(57) ABSTRACT

The gas exchange termination assembly overcomes the affects of fluid turbulence caused by wind, drafts, and air pressure. The invention can be applied to gas burning devices under 4,000 BTU input. Turbulent flow of gases at the gas exchange termination assembly are mitigated by the location of slots and openings in the gas exchange termination assembly for both intake air and exhaust gases. The gas exchange termination assembly is connected, coaxially through the building structural wall, to a sealed combustion system in order that all gases are drawn from and return to the same general location (directly) outside the building. The gas exchange termination assembly includes an intake air hood for intake air with additional intake air openings, an exhaust pipe with slots and a plug to move products of combustion at angles to the concentric pipe as the intake and exhaust gases enter and exit.

5 Claims, 2 Drawing Sheets

GAS EXCHANGE TERMINATION SYSTEM

BACKGROUND ART

Prior art is configured using concentric intake and exhaust where both intake and exhaust commute to atmosphere outside a building structure. Concentric passageways are constructed to be coaxial, one pipe within another. Various outside configurations, external to the building structure, are used to shield intake and exhaust gases in order to nullify the effects of outside (atmospheric) air, also known as weather conditions. Intake air is fresh air from outside a building structure. Exhaust is a combination of gases that are the product of a gas fuel burning or the oxidation reduction reaction that occurs when gas fuel is combined with oxygen found in air.

Prior art describes direct vent as communicating with the atmosphere outside a building. Direct vent systems combine the intake and the exhaust pipes into one concentric pipe. Prior art oversizes both exhaust and air intake pipes used for direct venting. In some prior art, exhaust gas moves into a single fitting where intake and exhaust may mingle, and where it dilutes the exhaust gases with intake air before exhausting to the atmosphere.

Prior art uses concentric piping arrangements for the convenience of making one penetration in the building structure. Concentric intake and exhaust is an interior coaxial passageway and a coaxial outer passageway. Both intake and exhaust share a single penetration that allows intake and exhaust to commute to the atmosphere outside a building structure.

Direct vent systems use various types of termination to communicate to the atmosphere outside a building. Termination is that part of the direct vent system that extends outside a building structure and is known as the point of entry for intake air and the point of exit for exhaust air. In termination systems of this type, illustrated in Valters U.S. Pat. No. 5,562,088 the combustion chamber within which the exhaust gases are generated, vents directly through an outside wall to the atmosphere outside of the building structure. Exhaust gases are piped through the center of an intake pipe, coaxially, where the intake commutes atmospheric air to support the combustion (burning) of a gas flame. In this prior art example the termination is attached to the outside of a building where the intake commutes atmospheric air to the gas flame and the exhaust commutes to the atmosphere through the concentric pipe that runs through the center of the intake pipe, coaxially. The termination holds both intake and exhaust pipes in a housing.

SUMMARY OF INVENTION

Technical Problem

The effects of wind, drafts, and air pressure differences caused by the outside atmosphere that are relative to the intake and exhaust of a gas burning appliance create pressure differences large enough to affect the flow of intake air to the gas fuel burning process. The burning, or oxidation reduction reaction, of propane or natural gas requires atmospheric air. The resulting exhaust gases from burning are a mix of carbon dioxide, carbon monoxide, unused air, and other trace gases. A gas flame is burned within a vessel typically referred to as a burner box that receives intake air and contains the burning gas which results in exhaust. Smaller gas burning devices are affected by slight differences in the flow of intake and exhaust gases that, sometimes, result in extinguishing the gas flame. Small gas burners have low BTU input and are more susceptible to the effects of atmospheric, or fluid, pressure differences caused by atmospheric turbulence, or weather conditions.

Solution to Problem

This invention, the gas exchange termination assembly, is a termination design that maintains a neutral pressure inside a burner and overcomes the effects of atmospheric fluid turbulence, or weather caused air pressure differences. The solution is attributed to the construction and configuration of the termination. The combination of slots for the exhaust and round openings in the intake, maintains a balanced pressure in the burner. The novel construction also includes an exhaust plug that requires exhaust gas to turn 90 degrees to the exhaust flow through the exhaust pipe to move the exhaust through the slots. Slots are positioned in the exhaust pipe to allow exhaust gas to move vertically up and down to exit. Rain and moisture drains from the bottom exhaust slots. Openings are placed in the intake air hood, a metal awning-shape feature, of the exhaust gas termination assembly so that intake air moves through them at varying angles to the flow of intake air in the intake air pipe. Placement of openings in the intake air hood and slots in the exhaust pipe reduce the pressure differential affect between exhaust and intake.

The gas exchange termination assembly is a wall mounted assembly that incorporates both the concentric commuting of intake and exhaust gases to and from a gas flame within a burner box. In this example, atmospheric air moves from outside a building structure to a burner where products of combustion are produced. The process of combustion occurs within the burner box by burning either propane or natural gas fuels. Exhaust gases are vented from the burner box to the outside through the exhaust pipe. Direct venting implies that commuting of intake and exhaust is sealed to and from the burner so that no gas is drawn from inside the building and exhaust is not allowed to vent into the building. The invention, the gas exchange termination assembly, includes a wall mounted assembly of intake air and exhaust pipes that are configured concentrically (one within the other) and require a single penetration through the wall for installation. The gas exchange termination assembly is secured to the wall using appropriate fasteners having a length necessary to penetrate the sheathing and connect to framing studs or structural substrata of the wall.

Advantageous Effects of Invention

The invention helps to prevent a gas flame from being extinguished by too much gas movement caused by atmospheric disturbance, weather, that affect the intake and exhaust of a small BTU input gas burner. The invention maintains a neutral pressure at the flame within the burner box. Gases are able to burn more efficiently by allowing intake air and combustion gases to move with minimal interference from the effects of atmospheric disturbance, known as weather conditions.

BRIEF DESCRIPTION OF DRAWINGS

The horizontal length of the intake air pipe 11—FIG. 1 is slightly longer than the width of the building structural wall thickness. The gas exchange termination assembly is held to the wall by fasteners 17—FIG. 1 that anchor to the building wall structural components.

—FIG. 2 is located behind the plug.

FIG. 4 is included to show the location of the gas exchange termination assembly in relation to the gas burning appliance and to provide an example of one type of piping arrangement between the gas exchange termination assembly and the burner box.

DESCRIPTION OF EMBODIMENTS

Figure 1:
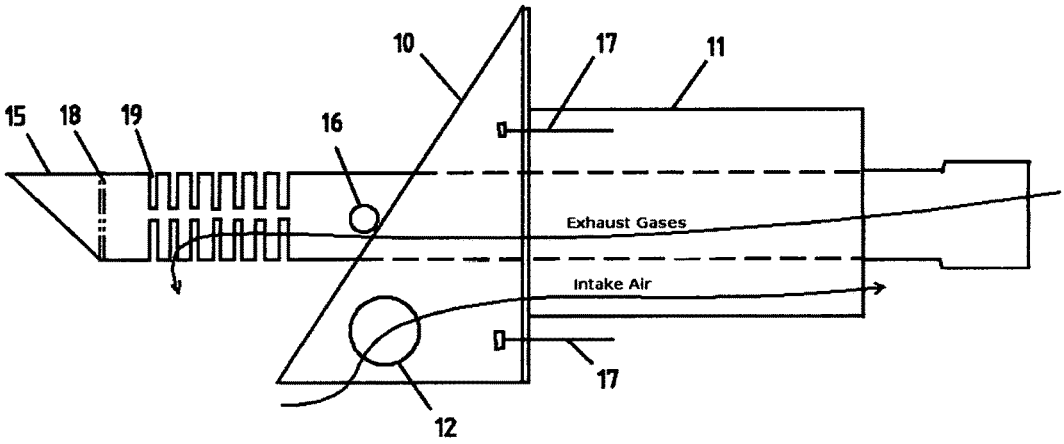
FIG. 1 shows a side elevation view of the gas exchange termination assembly. This view is given as if viewing the gas exchange termination assembly as it would extend through a structural wall that separates two independent environs, e.g., the inside and outside of a building structure.
Figure 3:
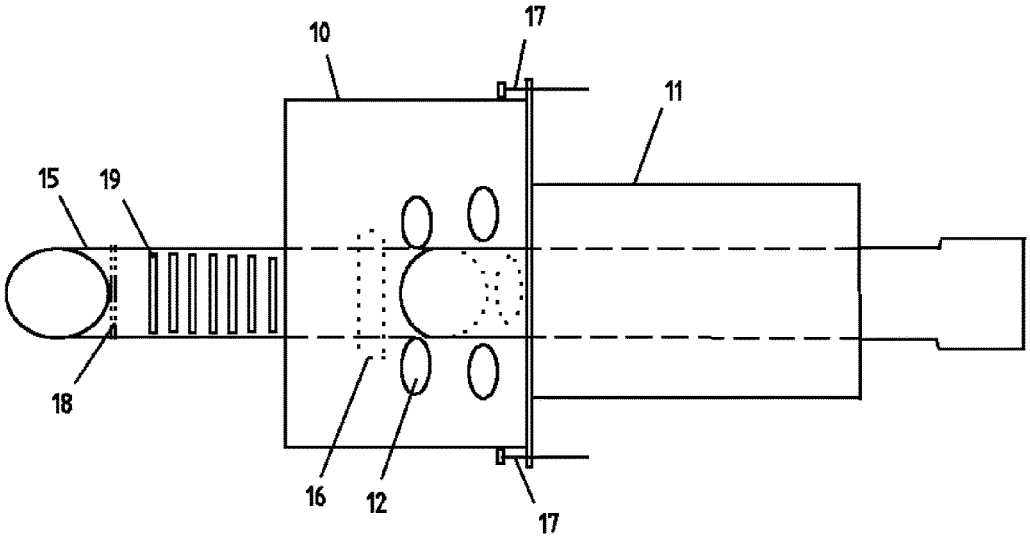
FIG. 3 shows the bottom view of the gas exchange termination assembly. This view shows the rectangular opening of the intake air hood. The rectangular opening of the intake air hood is open in this view. This opening allows outside air to move into the intake air pipe 11—FIG. 3 unobstructed. The intake air pipe is open to the intake air hood. Intake air holes 12—FIG. 3 also allow intake air to move into the intake air hood and to the intake air pipe 11—FIG. 3.
Figure 4:
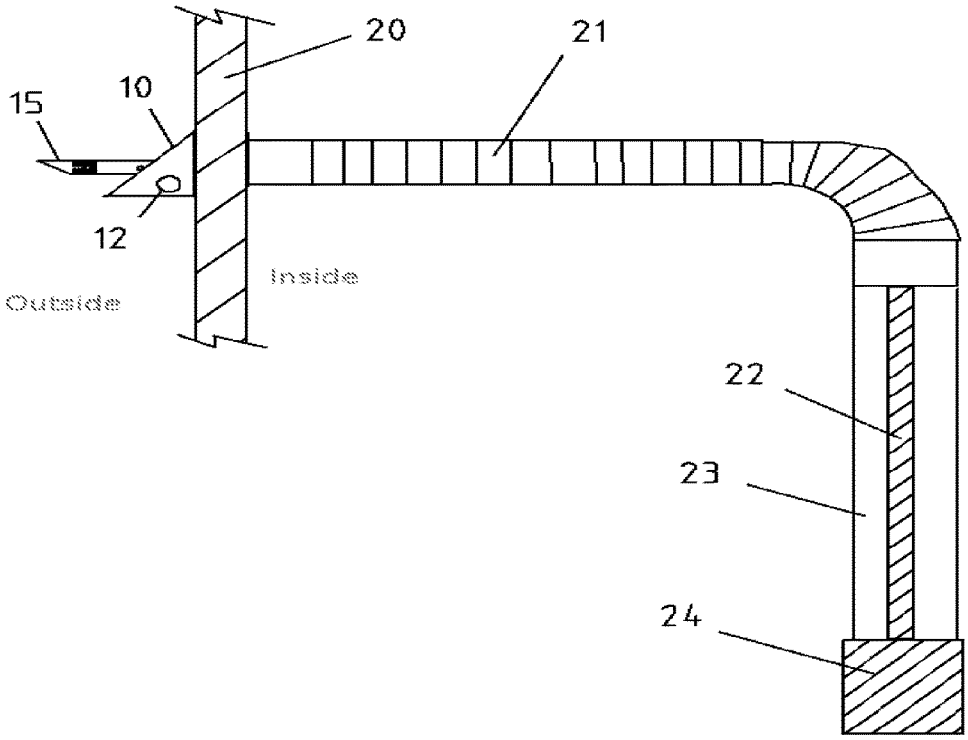
FIG. 4 shows a typical connection, from the gas exchange termination assembly located on the wall outside the building structure and connecting concentrically through the structure wall 20—FIG. 4 to piping that commutes to a gas burning appliance and burner box. The burner box would typically be connected integrally to the appliance (appliance not shown). All components, 21, 22, 23, 24 of FIG. 4, from the inside wall to the burner box that would be located integrally on the appliance are ancillary to this application and do not apply to the invention.

The invention is called a gas exchange termination assembly. The gas exchange termination assembly is an assemblage of parts, 11, 12, 15, 16, 17, 18 & 19 in FIG. 1, and can be considered as the gas termination assembly. The gas exchange termination assembly is constructed to control the flow of gases without other means of mechanical contrivance or powered conveyance, e.g., blowers. The gas exchange termination assembly is designed to be installed through the structural wall of a building requiring a single penetration for intake and exhaust piping. The gas exchange termination assembly is connected, by ancillary piping (21, 22, and 23 in FIG. 4), to an ancillary or burner box 24—FIG. 4 via ancillary concentric and/or non-concentric piping. The burner box receives intake air or outside air for combustion; burns a gaseous fuel; and produces exhaust gases, also known as flue gas, as a byproduct of the burning process. In FIG. 1, an interconnecting pipe referred to as an air intake pipe 11—FIG. 3 commutes outside air to the combustion chamber, through ancillary piping 21, 22, & 23—FIG. 4, in order to supply intake air (phantom arrow from left to right in FIG. 1). An exhaust pipe 15—FIG. 1 commutes exhaust gases from the combustion chamber (phantom arrow from right to left in FIG. 1). Intake air components of the gas exchange termination assembly are composed of an intake air hood 10—FIG. 1 that is open to outside air (intake air) at the bottom and has other openings 12—FIG. 1 (five shown in FIG. 2) to commute intake air through the intake air hood 10—FIG. 1. The intake air hood 10—FIG. 1 commutes with the air intake pipe 11—FIG. 1 that is open to the intake air hood 10—FIG. 1 and has a common radial center point and coaxial relationship with the exhaust pipe 15—FIG. 1. The exhaust pipe 15—FIG. 1 is located coaxially within the intake air pipe 11—FIG. 1 and extends through the intake air hood 10—FIG. 1, beyond the holding pin 16—FIG. 1, projecting beyond and into the outside air.

The gas exchange termination assembly is comprised of an exhaust pipe 15—FIG. 1 that is at the internal center of a coaxial piping arrangement with the exhaust commuting from the burner box through ancillary piping; connecting to the exhaust pipe 15—FIG. 1; and extending through and beyond the intake air hood 10—FIG. 1. The exhaust pipe, has an exhaust gas plug 18—FIG. 1, that requires the exhaust gas to turn direction 90 degrees to the flow of gases in the exhaust pipe 15—FIG. 1 before exiting through slots 19—FIG. 1 to the outside air. Exhaust gases commute from the burner box, through ancillary piping (21, 22, and 23—FIG. 4) to the exhaust pipe 15—FIG. 4 and through the building structural wall to the outside without mingling with, mixing with, diluting with, or sending exhaust gases to the inside of the building structure.

Figure 2:
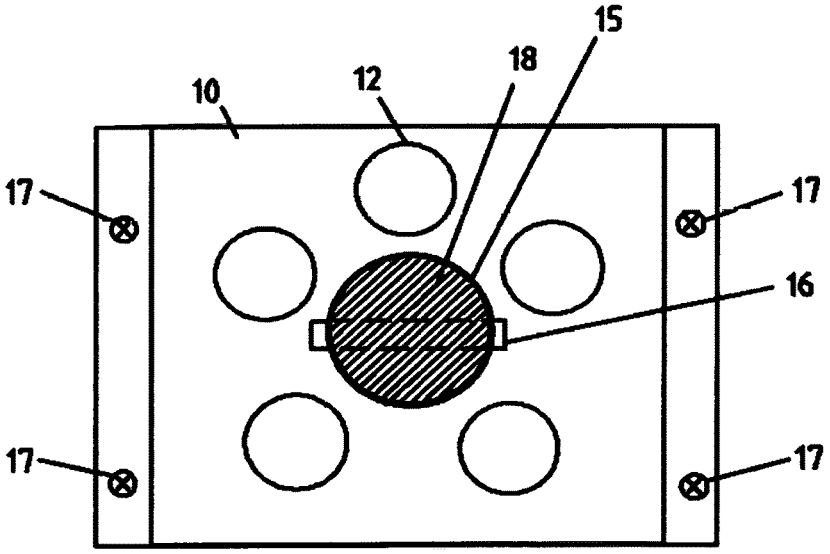
FIG. 2 shows the front elevation view of the gas exchange termination assembly. This view angle is as if viewing from outside the building. The exhaust plug 18—FIG. 2, located inside the exhaust pipe, can be seen as a hash-lined circle 18—FIG. 2 and the pin 16

For sake of illustration of the invention, the intake air hood shows a total of seven combined intake air openings in drawings FIG. 1 and FIG. 2. The intake air hood 10—FIG. 2 has intake air openings (showing five round penetrations 12—FIG. 2) that allow outside air to entering the air intake pipe 11—FIG. 1 through the intake air hood 10—FIG. 1. The intake air hood 10—FIG. 1 and intake air openings 12—FIG. 1 (showing one round opening with a similar opening directly behind 12—FIG. 1, for a total of 2 in this view) permit less turbulent flow of intake air with relation to outside air, thus helping the gas exchange termination assembly to maintain a neutral pressure in the burner box.

The exhaust pipe 15—FIG. 1 extends through the intake air hood 10—FIG. 1 and is plugged 18—FIG. 1 and slotted 19—FIG. 1 to require exhaust gases to change direction 90 degrees from the flow of gases in the exhaust pipe 15—FIG. 1 before exhaust gases exit to the outside air. The slots 19—FIG. 1 are positioned at the top and bottom of the exhaust pipe to allow rain and condensed moisture to drain from of the exhaust pipe 15—FIG. 1. The exhaust slots 19—FIG. 1 reduce atmospheric disturbance, weather conditions, that might affect the neutral pressure in the burner box (24—FIG. 4, ancillary to the invention).

REFERENCE SIGNS LIST

10—Intake Air Hood
11—Intake Air Pipe
12—Intake Air Openings (in Intake Air Hood), 7 Openings Shown
15—Exhaust Pipe
16—Pin (to hold Exhaust Pipe from moving toward inside of building)
17—Fasteners (to secure gas exchange termination assembly to building)
18—Plug (inside Exhaust Pipe)
19—Slots (top and bottom of Exhaust Pipe), 14 Slots Shown
20—Building or Structure Wall (ancillary to the invention)
21—Interconnecting Flexible Intake Air Pipe (ancillary to the invention)
22—Intake Air Pipe (from flexible pipe to burner box) (ancillary to the invention)
23—Insulation Pack (protects exhaust pipe from burner box) (ancillary to the invention)
24—Burner Box (also known as Combustion Chamber) (ancillary to the invention)

The invention claimed is:

1. A gas exchange termination assembly to reduce exhaust and intake air pressure differences, comprising:

a first pipe having an opening defining an area wherein the opening includes a plug within the first pipe and slots located before the plug so that air flow in the first pipe is directed out of the slots;

a second pipe having an opening defining an area wherein the second pipe is coaxial within the first pipe and the first area is smaller than the second area;

an air intake hood having a mounting side for mounting to a structure, an opposing side opposite the mounting side, two lateral sides, and an open bottom wherein the first pipe and slots extends through openings in the mounting side and the opposing side, and wherein the second pipe opening is attached to the mounting side of the air intake hood wherein the mounting side includes a plurality of air openings within the space defined by the second area of the second pipe to permit air to flow the through the air openings to the second pipe.

2. The gas exchange termination assembly in claim 1, further including at least one air intake opening on at least one of the lateral sides.

3. The gas exchange termination assembly in claim 1, wherein the opposing side is positioned at an angle.

4. The gas exchange termination assembly in claim 1, wherein the slots are located on the top and bottom of the first pipe.

5. The gas exchange termination assembly in claim 1, wherein the air openings are substantially circular.

* * * * *